US007950325B2

(12) United States Patent
Kachkovsky et al.

(10) Patent No.: US 7,950,325 B2
(45) Date of Patent: May 31, 2011

(54) TRASH COMPACTOR

(76) Inventors: Alexander Kachkovsky, Plymouth, MN (US); Kenneth Judge, Oakdale, MN (US)

( * ) Notice: Subject to any disclaimer, the term of this patent is extended or adjusted under 35 U.S.C. 154(b) by 284 days.

(21) Appl. No.: 12/144,235

(22) Filed: Jun. 23, 2008

(65) Prior Publication Data

US 2009/0314169 A1 Dec. 24, 2009

(51) Int. Cl.
*B30B 15/04* (2006.01)
*B30B 1/14* (2006.01)

(52) U.S. Cl. ..... 100/229 A; 100/285; 100/286; 100/289; 100/295

(58) Field of Classification Search ..... 100/215, 100/229 A, 280, 281, 282, 283, 285, 286, 100/287, 289, 295
See application file for complete search history.

(56) References Cited

U.S. PATENT DOCUMENTS 184,931 A * 11/1876 Unbehend ..... 100/264
364,995 A * 6/1887 Drew ..... 100/287
716,359 A * 12/1902 Allen ..... 100/257
3,527,161 A * 9/1970 Chandler et al. ..... 100/256
3,714,890 A * 2/1973 Moon ..... 100/229 A
3,772,984 A * 11/1973 Karls et al. ..... 100/215
3,842,729 A * 10/1974 Mandrup ..... 100/229 A
3,892,142 A 7/1975 Karls et al.
3,937,355 A 2/1976 Engebretsen
3,979,008 A 9/1976 Weeks et al.
4,018,148 A 4/1977 Wolbrink
4,024,806 A 5/1977 Weeks et al.
4,041,856 A 8/1977 Fox
4,064,798 A 12/1977 Wolbrink et al.
4,096,421 A * 6/1978 Farber et al. ..... 318/282
4,100,850 A 7/1978 Wolbrink et al.
4,444,099 A 4/1984 Paleschuck
4,565,125 A * 1/1986 Khan ..... 100/214
4,638,730 A * 1/1987 Bonacorsi ..... 100/229 A
5,465,660 A * 11/1995 Conti et al. ..... 100/48
6,367,377 B1 4/2002 Gawley et al.

* cited by examiner

*Primary Examiner* — Jimmy T Nguyen
(74) *Attorney, Agent, or Firm* — Roger Belfay

(57) ABSTRACT

A side loading trash compactor, comprising a frame defining a cavity, a receptacle for containing trash, a platen movable to compress trash collected in the receptacle, a first set of linkages having a first end attached to the frame by a first simple hinge joint, the first simple hinge joint having an axis of rotation, and a second end attached to the platen by a second simple hinge joint, a second set of linkages having a first end attached to the frame by a third simple hinge joint, and a second end attached to the platen by a fourth simple hinge joint, and a drive mechanism configured to move the plate up and down, wherein the first and second set of linkages operate in intersecting planes.

12 Claims, 12 Drawing Sheets

TRASH COMPACTOR

FIELD OF THE INVENTION

This invention pertains to trash compactors and trash compactor mechanisms for use in restaurant dining rooms, kitchens and the like that periodically compact trash into a trash receptacle at the bottom of the unit.

BACKGROUND

Trash compactors are useful because they reduce the frequency that a particular trash collection unit needs to be emptied and they reduce the overall volume of trash collected. For example, in restaurant dining rooms, the principle components of the waste are napkins, sandwich wrappers, paper cups and food waste. In a typical fast food restaurant, patrons can fill a trash container with these low density item quickly. The trash container, filled with low density waste, needs to be emptied by an employee more frequently and such trash fills up a dumpster or other collection unit more rapidly. In contrast, a dining room trash compaction unit is filled up by patrons over a longer period of time and produces a higher-density waste. Thus, trash compaction units need to be emptied by employees less often and a single dumpster can hold more waste. This reduces costs.

Most trash compactors share a basic design; a horizontal platen is pressed downwards to compress trash into a receptacle at the bottom of the trash compactor. One point of difference among trash compactor designs is in the mechanism used to actuate the platen. For example, in U.S. Pat. No. 6,367,377 to Gawley et al., a scissors-type mechanism is operated by a horizontal screw actuator. One set of feet are connected to the platen and another set of feet slide in a pair of tracks or on a rack-and pinion of the platen. As the platen is forced downward to compress the trash, the screw experiences ever increasing bending moments and the forces from the scissors mechanism on the platen are applied in an increasingly asymmetric manner. The parts of the mechanism need to be beefier to compensate for this disposition of forces. Further, there is a chance that debris might become lodged between the sliding feet and the rack-and-pinion mechanism in the platen, which would jam the mechanism. Another typical prior art design is found in U.S. Pat. No. 4,100,850 to Wolbrink et al., where the electric motor powering the compacting mechanism moves up and down with the compacting mechanism. This type of design puts undue stress on the electrical leads as they flex to follow the motor through the compaction cycle and the platen does not follow a perfectly vertical path. U.S. Pat. No. 4,024,806 to Weeks et al. describes a trash compactor that requires two vertical screws to drive the compacting mechanism and stabilize the platen.

What is desirable is for further trash compactor designs that reduce the chance of contaminating the compacting mechanism with trash, increase reliability and safety, and reduce cost.

SUMMARY

In a first aspect, there is an apparatus for compacting trash. The apparatus includes a compacting mechanism that has multiple sets of linkages that are connected by a simple hinge joint to the platen and to the frame of the apparatus. The linkages may be driven by a single vertical screw actuator. At least one set of linkages operates in a plane that is at an angle to the plane of another set of linkages. In one preferred embodiment, a single vertical screw actuator drives four sets of linkages, two of which are disposed in planes that are perpendicular, or normal, to the planes of the other two sets of linkages.

In another aspect, the sets of linkages are connected to the vertical screw actuator by a movable plate, which the screw actuator moves up and down. This connection of the sets of linkages to the movable plate may involve an additional linkage to each set of linkages.

Another embodiment involves a set of linkages attached to a drive mechanism to provide force to move the platen up and down. Another set of linkages is attached to the drive mechanism and two additional sets of linkages are attached to the frame of the embodiment at an angle to the first set of linkages to provide stability and balance to the platen.

Another aspect provides for a platen that includes a wide rim disposed around the bottom plate of the platen and may include an outward lip above the rim. The platen may also include one or more beveled edges to the bottom plate.

Another aspect provides for an inlet door, for a user to dispose of trash into the trash compactor, that can be opened by the user or by an inlet door opening mechanism. The inlet door opening mechanism may have a portion attached to the inlet door that moves with the inlet door and another portion, which may be attached to the frame, that does not need to move with the inlet door. This portion includes a motor and means to move the portion attached to the inlet door to open the inlet door or to allow the inlet door to close. A proximity sensor may be positioned near the inlet to detect the approach of a user, and one or more sensors may be disposed on the inlet door to detect whether the door is opened or closed.

Another aspect provides for a trash receptacle that may be wheeled out from the trash compactor and in which a compact block of compressed trash of manageable size and weight may be formed and easily removed.

The above summary of some example embodiments is not intended to describe each disclosed embodiment or every implementation of the invention.

BRIEF DESCRIPTION OF DRAWINGS

The invention may be more completely understood in consideration of the following detailed description of various embodiments in connection with the accompanying drawings, in which.

Figure 1:
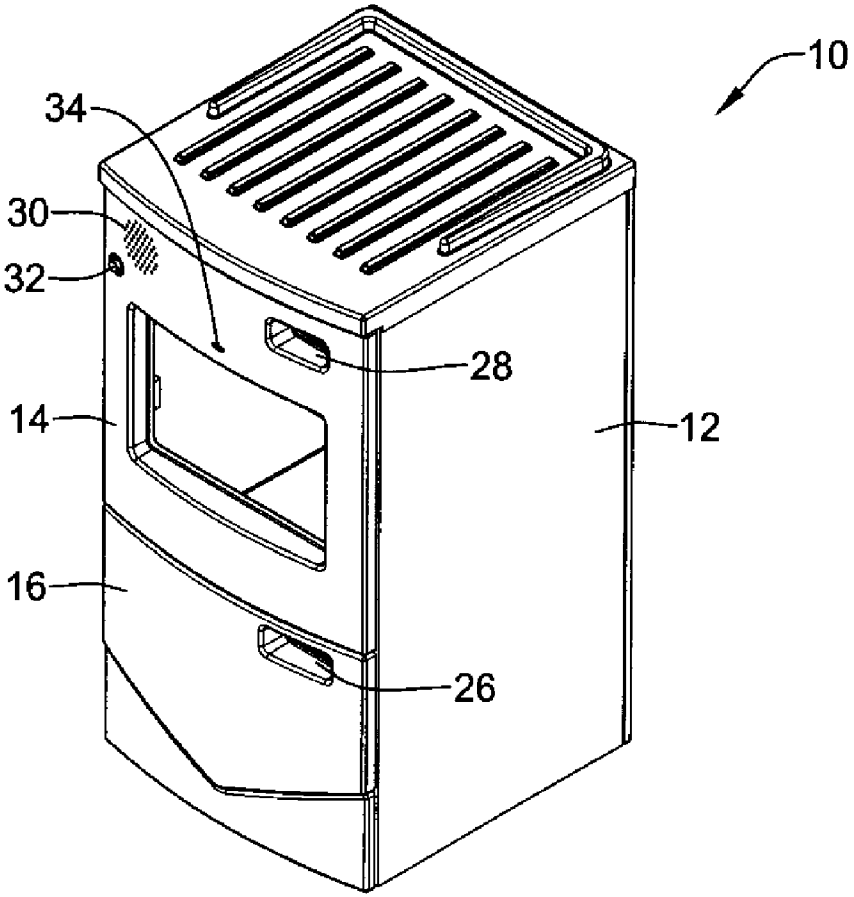
FIG. 1 is a perspective view of one embodiment of a trash compactor.

While the invention is amenable to various modifications and alternative forms, specifics thereof have been shown by way of example in the drawings and will be described in detail. It should be understood, however, that the intention is not to limit aspects of the invention to the particular embodiments described. On the contrary, the intention is to cover all modifications, equivalents, and alternatives falling within the spirit and scope of the invention.

DETAILED DESCRIPTION OF SELECTED EMBODIMENTS

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the invention. The illustrative embodiments depicted are intended only as exemplary. Selected features of any illustrative embodiment may be incorporated into an additional embodiment unless clearly stated to the contrary.

By way of general overview, a trash compactor 10, shown in perspective view in FIG. 1, includes a housing 12, which surrounds the unit on the four sides and the top. The front side of the housing includes an upper door 14 and a lower door 16. The upper door 14, which will be described in more detail below, includes an inlet door 18, through which trash is disposed of into the unit. Some of the major internal components not shown in this first figure include the compacting mechanism 20, trash receptacle 22 and frame 24. The frame, of course, provides the structure to which all the other components are attached.

The operation of the trash compactor may start with providing a liner for the trash receptacle. When a person approaches the trash compactor, a proximity sensor or other sensor is triggered to open the inlet door, which allows the person to introduce garbage through the inlet door. Alternatively and in at least one embodiment, the inlet door may also open when a person pushes on it. At predetermined intervals the compacting mechanism compacts the trash in the trash receptacle. The trash compactor may provide a signal to indicate that the trash receptacle is full and the liner should be replaced. This may be done by opening up the lower door and wheeling out the trash receptacle.

The housing 12 may be fixed to the frame and may be made of panels of metal, plastic such as acrylic, wood, a combination of such materials or other suitable material or combination of materials. The housing may include, for example, a tray collector molded into its top panel. The housing configuration may vary depending on the contemplated installation of the trash compactor. For example, for a cabinet mounted configured, where only the front panel of the trash compactor is exposed, the housing may be reduced to only the upper and lower doors of the front panel, may eliminate the upper panel, or some other preferred configuration. Lower door 16 may include a lower door latch 26, which may be lockable, and which may be operated to open the lower door. Likewise, the upper door 14 may include a lockable upper door latch 28, which can be operated to open the upper door panel. In this embodiment, the lower door may be opened regularly to provide access to the trash receptacle while the upper door, while operable, needs to be opened only to provide access to service the internal mechanisms of the trash compactor. As can be seen from FIG. 1, upper door 14 may also include speaker aperture 30, signal light aperture 32 and proximity sensor 34.

Speaker aperture 30 may be a regular array of holes or other opening or set of openings through which a speaker may be heard. In this embodiment, a speaker (not illustrated) is mounted to the frame 24 and does not move with upper door 14 when it is opened. Likewise, signal light aperture 32 may be an opening or set of openings through which a signal light may be seen. Signal light aperture 32 may include a transparent or translucent cover or may be a naked hole in the upper door. The light may be mounted to the frame so that it does not move with upper door 14 when it is opened. Of course, both the speaker and the signal light may be mounted to the upper door if desired or may be located in another part of the housing. Other suitable auditory and visual output mechanisms may be included. Such mechanisms can be used to provide cues and information to users, who are throwing trash into the trash compactor, and service people, who may empty the receptacle and perform other maintenance tasks.

In this embodiment, proximity sensor 34 is mounted in the upper door 14 directly above the inlet door 18 and senses movement near to the sensor. Other contemplated locations for the proximity sensor or for a second proximity sensor include locations on the inlet door. The proximity sensor provides signals to the inlet door opening mechanism and can be adjusted or configured to provide a desired level of sensitivity and range of detection.

Figure 2:
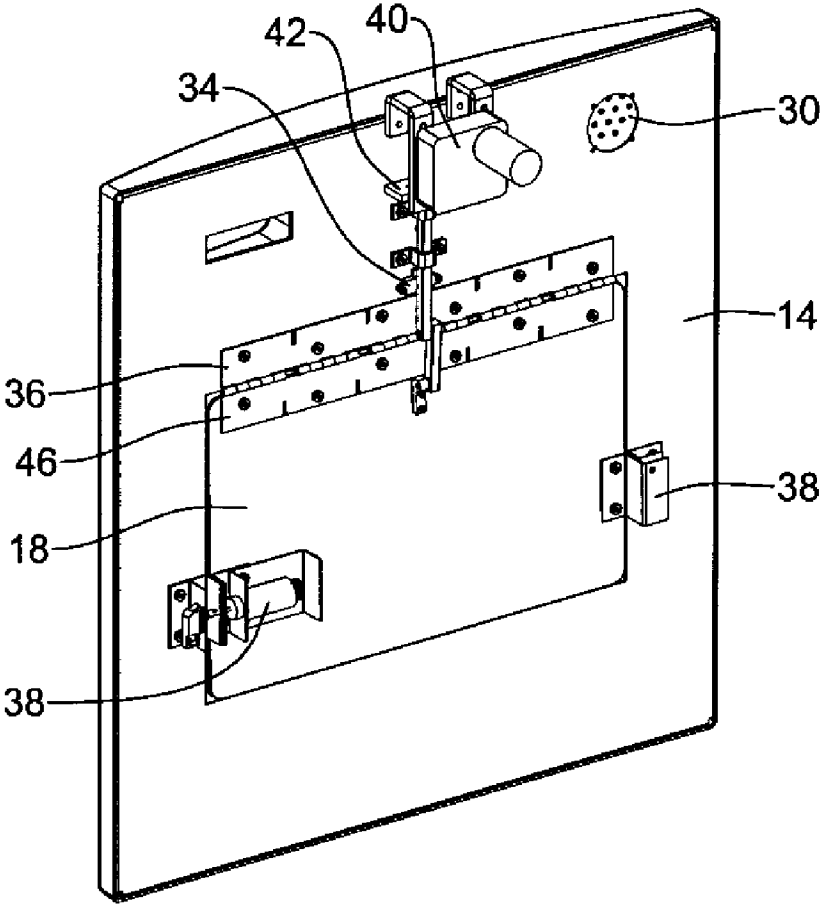
FIG. 2 is a rear perspective view of an upper door of the embodiment of FIG. 1.

Turning now to FIG. 2, the rear of upper door 14 is shown. The back of upper door latch 28, proximity sensor 34, speaker aperture 30 and signal light aperture 32 may be seen. It can also be seen that inlet door 18 is mounted to the upper door 14 with a hinge 36, about which the inlet door pivots. Hinge 36 may include a flex sensor by which the location of the inlet door may be monitored. The inlet door hinge may also be spring-loaded to return to the closed position. One or more additional inlet door sensors 38 may also be included to provide redundant information to the control unit on the location of the inlet door. Any suitable sensor, such as a magnet sensor or a solenoid sensor may be used. A solenoid or other suitable locking mechanism may also be included to lock the door closed during compacting operations.

Figure 3:
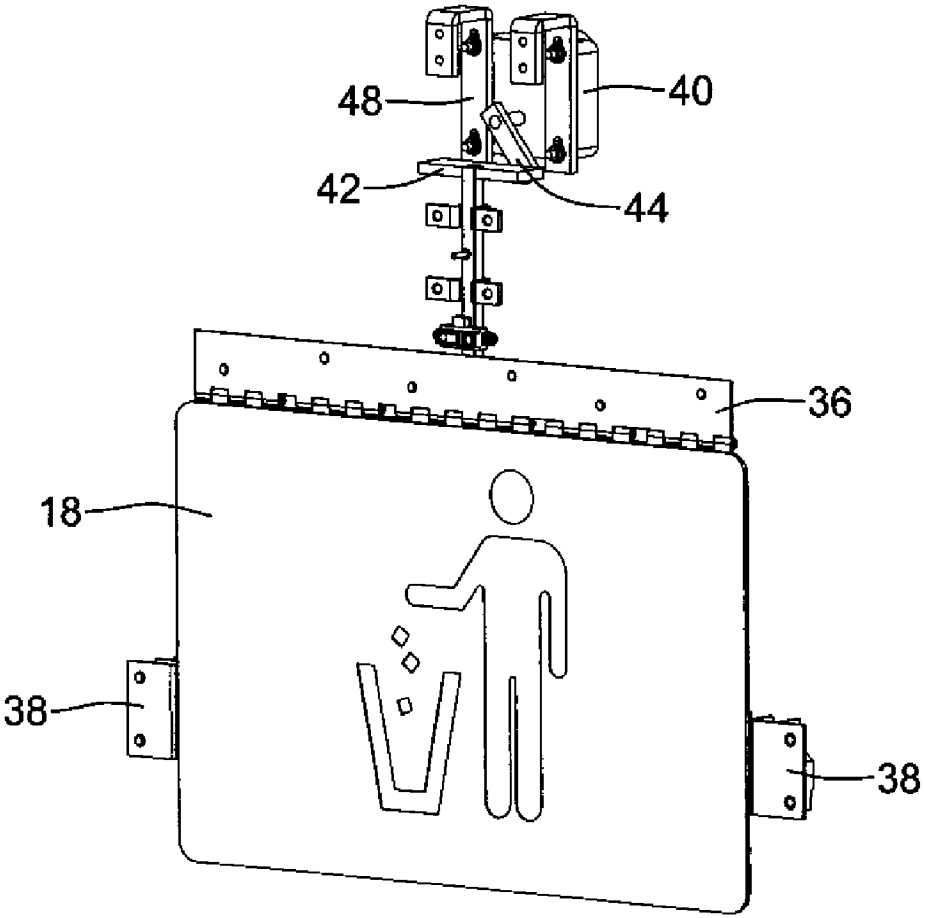
FIG. 3 is a front perspective view of certain elements of the upper door of FIG. 2.

The inlet door includes an opening mechanism 40. The opening mechanism has two portions, one of which may be mounted to the upper door and the inlet door and one of which may be mounted to the frame. The two portions are preferably designed to separate when the upper door is opened. The opening mechanism can be seen clearly with reference to FIGS. 2 and 3. FIG. 2 shows the rear of upper door 14. FIG. 3 is a front view of the opening mechanism that includes the inlet door hinge and the top portion of the inlet door, but in which has the upper door removed.

The first portion of the opening mechanism, which is mounted to the upper door and the inlet door, includes a T-shaped linkage 42, the upper end of which rests on a pin 44 and the lower end of which is pivotably connected to a strut 46. Strut 46, in turn, is pivotably connected to the inlet door. Linkage 42 is preferably confined by brackets to the upper door so that it can only move vertically. As the linkage 42 moves up or down, the inner door opens or closes.

The second portion, which is mounted to the frame, includes a motor 48, a rotable arm and a pin 44. The pin is offset from the rotational output of the motor so that the motor can rotate the pin along an arc. Because the T-shaped linkage rests on pin 44, it can be raised either by the pin or independently of it. Further, the upper door can be opening and closed easily, as the link between the two portions of the mechanism is easily separated and rejoined. Of course, any mechanism by which pin 44 can be lifted up and down may be used in the second portion of the opening mechanism. The motor may be selected to retain the position of its output mechanism when power is cut. Thus, for example, if a trash compactor loses power when the inlet door is open, the inlet door will be retained in its position and not close on a user's arm.

Because the first portion of the mechanism can, in some instances, be moved independently of the second portion, there are thus two ways of opening the inlet door 18. In one method, a signal from the proximity sensor is received by a controller, which then tells the motor to rotate. As the pin is rotated by the motor, it slides along the T-shaped linkage while raising its vertical position. As the pin is lifted, so too is the T-shaped linkage, which, because it is mechanically linked to the inlet door, opens the inlet door.

In a second method, the inlet door can be pushed in by a person throwing trash away. The T-shaped linkage is thereby raised independently of the pin. Because the sensors can detect the inlet door opening, the pin can be raised to the T-linkage to keep the inlet door in the open position and to provide for a controlled door closing. Alternatively, pushing on the inlet door triggers one of the inlet door sensors, which sends a signal to the controller. Examples of suitable sensors include solenoids, magnetic sensors, flex sensors and the like. The controller then tells the motor to rotate. In this manner, a person who pushes on the inlet door may be assisted by the opening mechanism in opening the inlet door.

The door mechanism may also include stop limiters (not pictured) attached to the upper door, the housing or the frame to limit the extent that the inlet door may be opened. Of course, other suitable opening mechanisms for the inlet door may be used with various embodiments.

Figure 4:
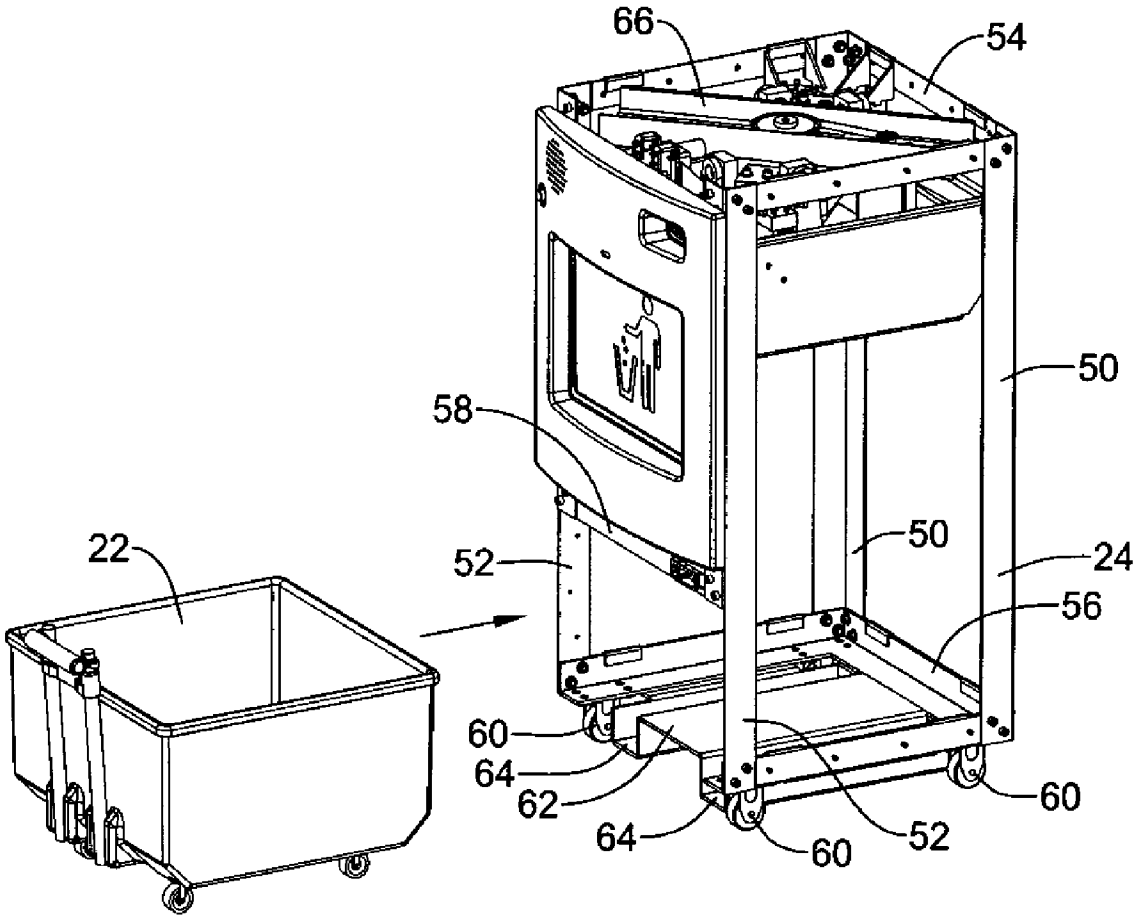
FIG. 4 is a perspective view of the embodiment of FIG. 1 with certain components removed.

Turning now to FIG. 4, frame 24 may be seen more fully. Frame 24 includes two vertical rear posts 50 and two vertical front posts 52 that are connected to a four-sided top frame 54 and a U-shaped bottom frame 56. The two rear posts 50 are L-shaped and most of the two front posts 52, except for a lower front portion widened to receive the trash receptacle, are L-shaped as well. A front cross-piece 58, mounted above the location of the trash receptacle, may also be included to provide additional rigidity and strength. The frame also includes a top cross-piece 66, which is used in attaching and supporting the compacting mechanism. The frame may be made from steel or other suitably strong material and may be assembled by bolts, welding, manufacturing components together, or some other suitable technique. The frame 24 is preferably mounted on wheels 60, though of course the frame may also be set directly on feet or on the ground. The frame defines the overall shape of the trash compactor. In this embodiment, the overall shape is that of a rectangular box. In other embodiments, the trash compactor may have a different overall shape and correspondingly different frame components. For example, the trash compactor, and thus the frame, may have a cylindrical shape. The frame may also be made using other techniques. For example, each side of the frame may be stamped from a single piece of material and the sides may then be joined using a suitable technique.

The wheels of the trash compactor or the bottom of the frame provide room for a trash receptacle support 62. The trash receptacle support is a bottom panel piece that includes channels 64 that guide and support the wheels of the trash receptacle. Preferably, the bottoms of channels 64 clear the floor by only a modest distance so that the trash receptacle can be easily wheeled into and off from support 62. The channels may include detents or holes that correspond to the wheels of the trash receptacle. These detents may provide tactile feedback to indicate when the trash receptacle is properly placed, may keep the trash receptacle from rolling out of position and may allow the trash receptacle support, rather than the wheels of the trash receptacle, to bear the brunt of the force during a compaction cycle.

Figure 8:
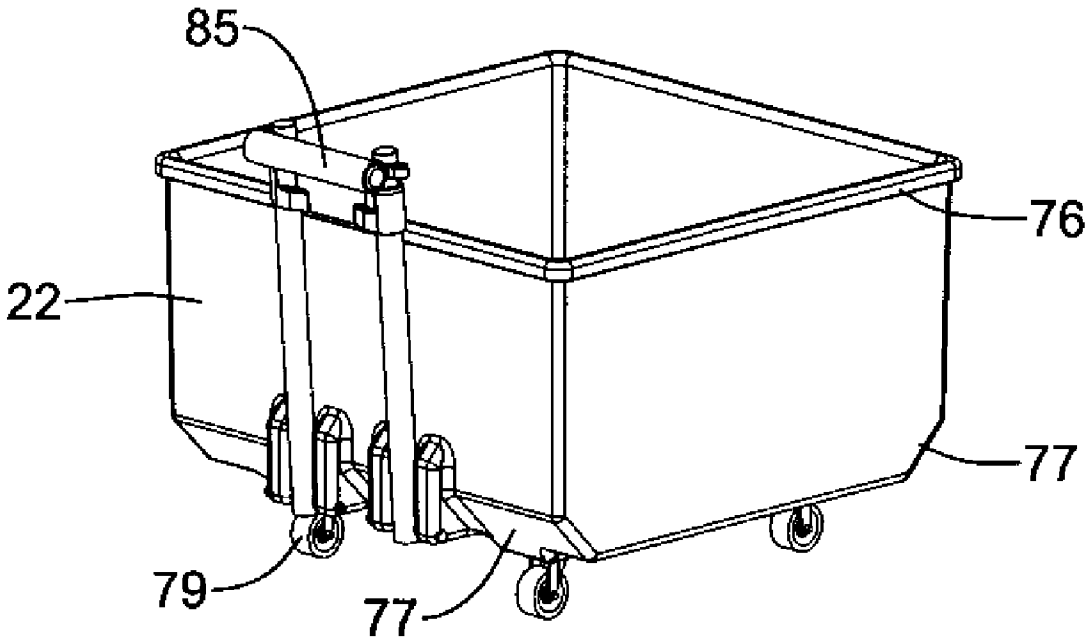
FIG. 8 is a perspective view of a trash receptacle for use with a trash compactor embodiment.

The trash receptacle 22, shown in FIG. 8, is preferably rectangular with vertical side walls. In one embodiment, the trash receptacle includes one or more beveled or curved edges 77 along its bottom surface. Such a configuration eliminates corners with sharp angles, may aid in guiding the trash receptacle into position and may make it easier to remove a brick of compacted trash from the trash receptacle. The trash receptacle may include wheels 79 to ease the movement of the trash receptacle into and out of position. A lip 76 on the upper rim of the trash receptacle may add rigidity. In one embodiment the trash receptacle is about 12 inches deep, although other dimensions are of course possible. Trash receptacle 22 may also include a handle 85 that may telescope up and down to provide easy maneuverability.

Figure 5:
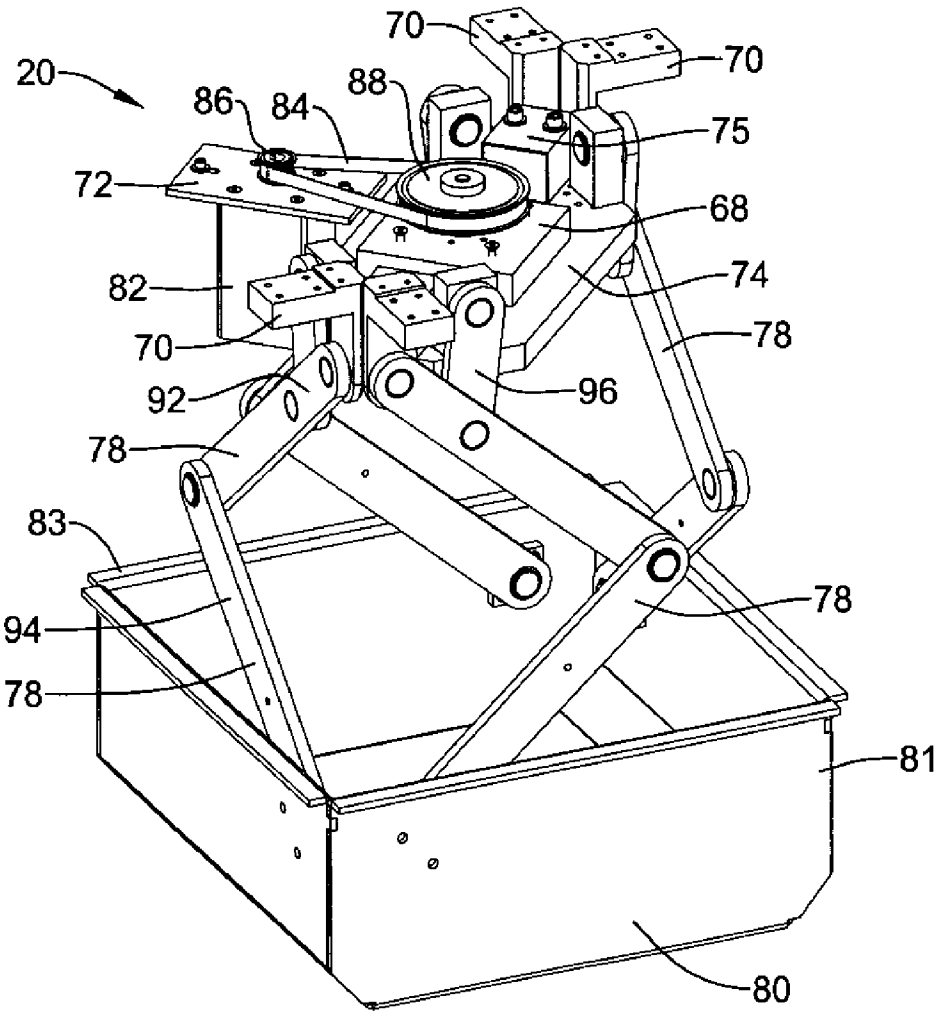
FIG. 5 is a perspective view of a trash compactor mechanism.
Figure 6:
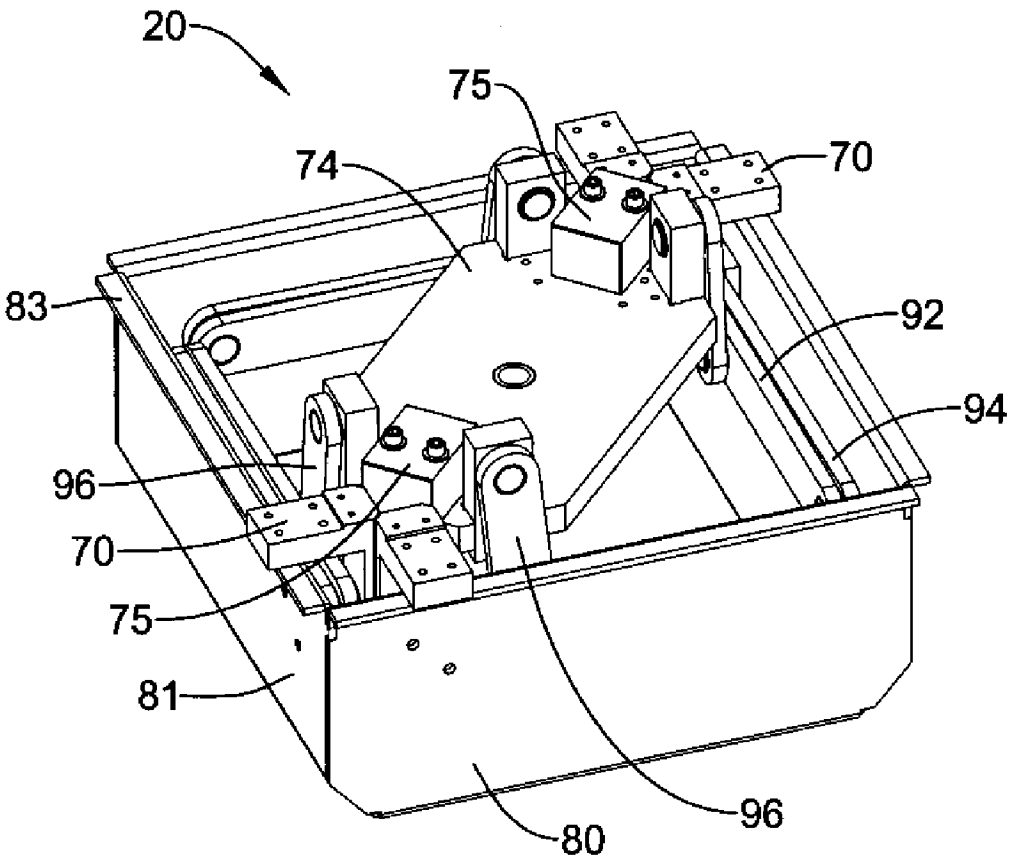
FIG. 6 is a perspective view of certain components of the trash compactor mechanism of FIG. 5.
Figure 7:
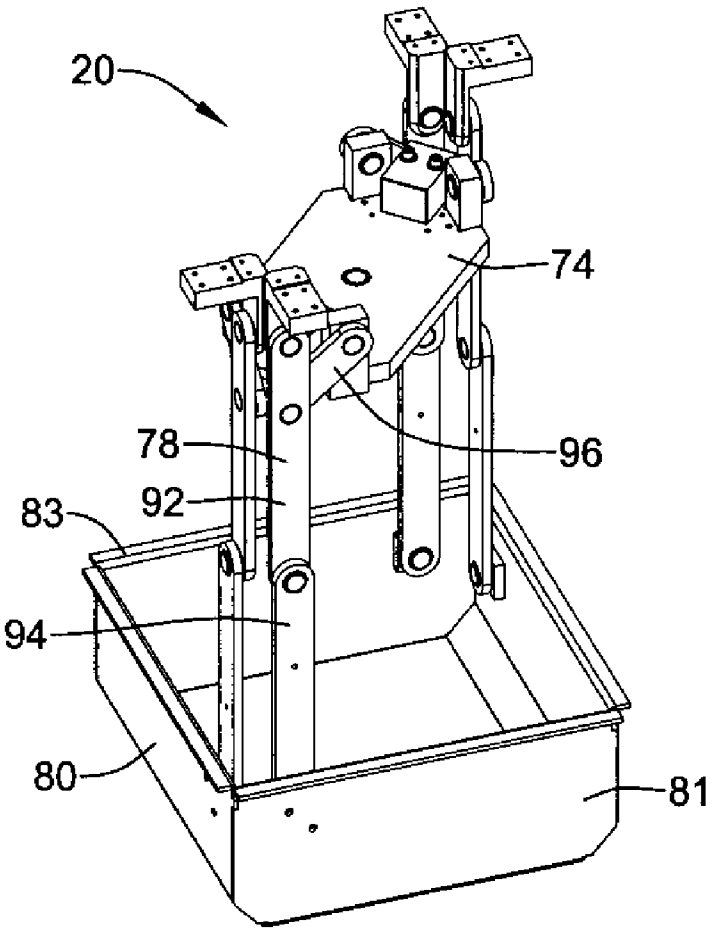
FIG. 7 is a perspective view of certain components of the trash compactor mechanism of FIG. 5.

Turning now to FIGS. 5, 6 and 7, the compacting mechanism 20 may be understood more fully. The general principle of operation may be seen by understanding which parts are fixed and which may move. FIGS. 5, 6 and 7 illustrate the compacting mechanism without the frame, to which screw actuator bracket 68, drive mechanism 72 and brackets 70 are attached. These parts are therefore fixed. Moving plate 74 moves up and down along the screw actuator, which rotates. This in turn, straightens and collapses linkages 78, which provides force to platen 80.

Platen 80 is a component with a generally flat bottom surface for compressing the trash into the trash receptacle and may include side walls 81 and upper lip 83 to align the platen within the trash receptacle and to prevent trash from accumulating on the platen. Preferably, the side walls are sized so that the upper lip is always above the trash receptacle. Ordinarily, when trash is being compressed in the trash receptacle, the side walls of the platen are at least partially disposed within the trash receptacle. This confines trash to the trash receptacle and prevents contamination of the compacting mechanism. Further, the upper lip, which extends outwardly from the side walls directs any potential spray of liquid trash away from the compacting mechanism.

It can be appreciated that the cross-sectional shape of the platen 80 and the cross-sectional shape of the trash receptacle should preferably correspond so that the platen is compressing the entire surface of the trash. A square or rectangular shape is the most efficient shape for the platen and the trash receptacle, though of course other shapes, such as circular or octagonal are within certain embodiments. The platen may also include a beveled front edge, which accommodates the opening of the inlet door. A chamfer on the rear edge may also be included. In embodiments that include a rear inlet door, this rear chamfer may accommodate the opening of the rear inlet door. These chamfers also aid in removing trash and add rigidity. In one contemplated embodiment, the platen may include chamfers around the circumference of the flat bottom surface. The flat bottom surface may also include ribs or ridges to create higher and lower pressure areas to better compress the trash.

The drive mechanism is an electric motor 82 connected to one end of the screw actuator by a pulley and belt system. Belt 84, drive pulley 86 and driven pulley 88 are shown. By selecting the electric motor and the diameter of the wheels, one can deliver a desired torque to the screw actuator at a desired rotational speed. This particular drive mechanism keeps the position of the compacting mechanism fixed even when power is turned off, except when the motor is operating, although other drive mechanisms may be used. The screw actuator is fixed vertically within the screw actuator plate and has the same axis of rotation as driven pulley 88 and is free to rotate about its vertical axis. As the screw actuator rotates, it drives the moving plate up and down. The screw actuator may be mounted in the moving plate by use of a floating bearing, which is free to rotate somewhat with respect to the drive plate. This floating bearing connection prevents unwanted forces from building up around the screw actuator. Further, there may be a position sensor on the moving plate to indicate when the plate is in the raised position.

The four linkages 78 are preferably generally symmetrically disposed about the two vertical planes, one between the first and second adjacent linkages and the third and fourth linkages and the other between the second and third adjacent linkages and the remaining two. As can be seen from FIG. 5, this arrangement provides that two of the linkages extend from one corner of the drive mechanism and the remaining two linkages extend from the opposite corner and that the linkages are fastened to the corresponding corners of the platen. Other than this arrangement, which balances forces on the drive mechanism and platen, the linkages of this embodiment are similar. For this reason, only one linkage will be discussed, although it should be understood that the discussion is applicable to each linkage. Linkage 78 has three components, upper linkage 92, lower linkage 94 and drive linkage 96. Upper linkage 92 has a first end connected to bracket 70 and a second end connected to lower linkage 94. Lower linkage 94 has a first end connected to the upper linkage and a second end connected to platen 80. Drive linkage has a first end connected to moving plate 74 and a second end connected to upper linkage 92 between the two ends of the upper linkage. Changing the length of the linkages and the connection position changes the force applied to the platen and the distance the platen may travel. In one embodiment, the linkages may not be completely retracted when the platen is in its highest position so that there is a slight angle between the upper and lower linkages.

The drive plate 74 may include guide blocks 75, which may be made from nylon or other suitable material. These guide blocks may help keep the lateral alignment of the drive plate. Another suitable alignment mechanism may be used as desired in place of or in addition to guide blocks 75.

In one embodiment, the moving plate travels for about 5 inches along the screw to produce about 28 inches of travel in the platen, and the compacting mechanism linkages can fit within an about 23 by about 23 inch square.

Each of the connections to the upper, lower and drive linkages allows one degree of rotational freedom. Such connections shall be referred to herein as simple hinge joints. Simple hinge joints can be formed between the linkages by using pins whose ends are captured using C-rings, by press-fitting a pin into one of the linkages and capturing the other end of the pin with a C-ring, or by some other suitable method. Other components such as roller or ball bearings may be included as well.

The four linkages 78 cooperatively stabilize and fix the position of platen 80. Because the linkages 78 are preferably symmetrical as described above, lateral forces on the plate are cancelled out. The compacting mechanism can thereby go from a fully raised position as shown in FIG. 6 to a fully extending position as shown in FIG. 7.

Of course, other compacting mechanisms operating on the same general principles are contemplated. For example, the compacting mechanism described above may have a moving plate that is raised or lower by a different mechanism than that of the screw actuator and drive mechanism described above, and the number and orientation of the linkages may be changed. For example, a ball actuator may be substituted for the screw actuator.

Figure 9:
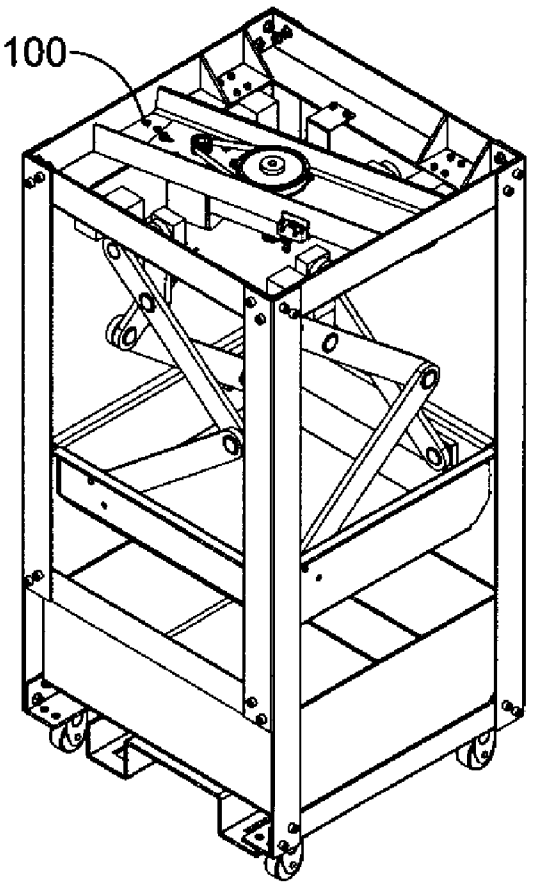
FIG. 9 is a perspective view of another embodiment of a trash compactor with certain components removed.
Figure 10:
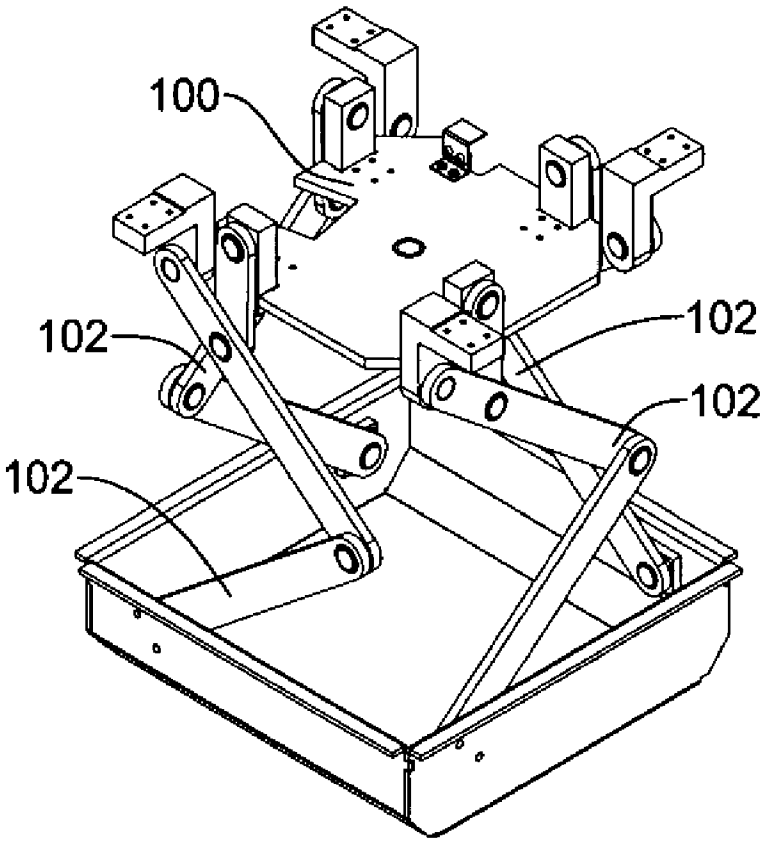
FIG. 10 is a perspective view of some of the compactor elements of the embodiment of FIG. 9.

Another alternative embodiment may be described with reference to FIGS. 9 and 10, which are partial views of a trash compactor illustrating a somewhat different drive mechanism 100, which operates according to the same general principals as described above, but in which linkages 102 are arranged symmetrically about the axis of the screw actuator. This embodiment illustrates that the linkages may be arranged in a wide variety of manners. For example, the linkages need not be symmetrically disposed nor do the linkages need to be at right angles to each other. Four linkages are shown both in this embodiment and in the previous embodiment but variations of any embodiment may include fewer or more linkages as preferred.

Figure 11:
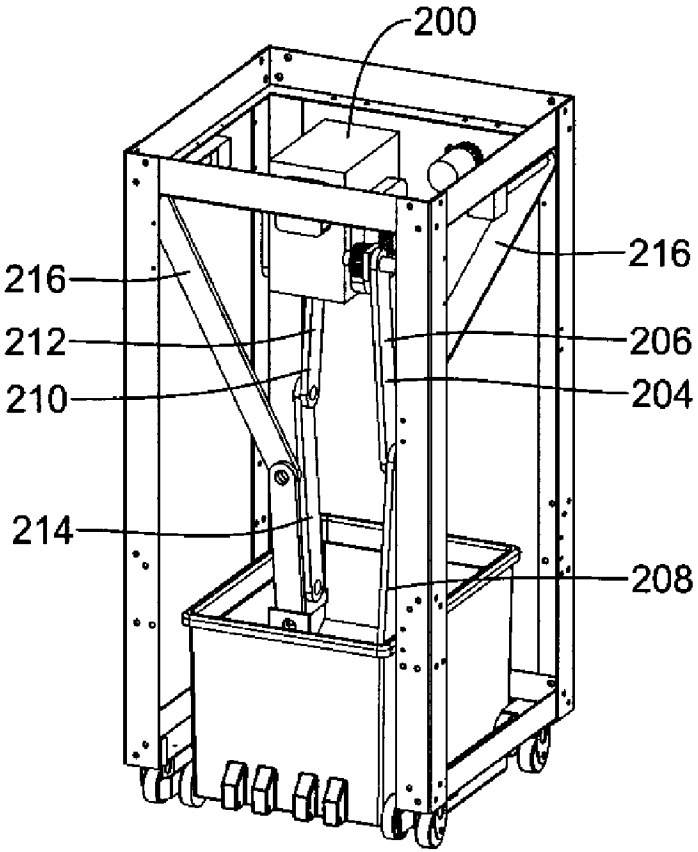
FIG. 11 is a perspective view of another embodiment of a trash compactor with certain components removed.
Figure 12:
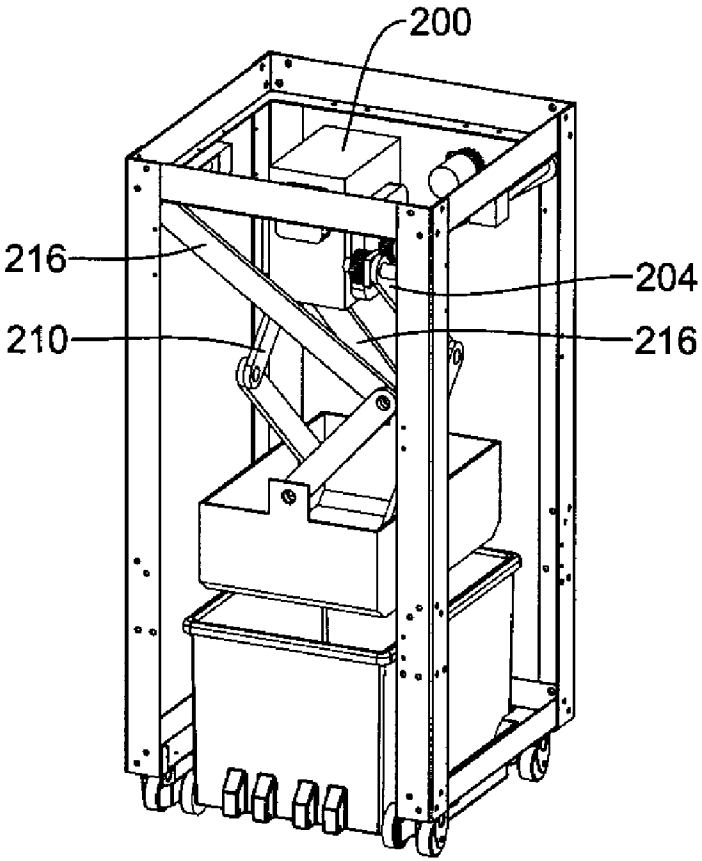
FIG. 12 is another perspective view of the embodiment of FIG. 11 with certain components removed.

Another alternative embodiment may be described with reference to FIGS. 11 and 12, which embodiment includes a drive mechanism 200 having an output that rotates horizontally. This output is connected to a linkage 204, via one or more gears as preferred. Linkage 204 has a drive arm 206 and a lower arm 208. Lower arm 208 is connected to the platen. A second linkage 210 may be attached to the other side of the drive mechanism and includes an upper arm 212 and a lower arm 214. Balance linkages 216 each include an upper arm and a lower and are attached to the frame and to the platen. The drive linkage provides the necessary force to the platen and the positioning of the four linkages ensures the platen is positioned correctly and securely. The arms of the linkages are connected using pins or other connections having one degree of rotational freedom.

This embodiment illustrates that the drive system and the guide linkage system need not be integrated as they are in the preceding two embodiments. The drive system may be any suitable drive system such as the drive screw systems described above, a geared system, a hydraulic system or the like. The guide linkage system generally includes at least two linkages, where each linkages operates in a plane and where the planes of at least two of the guide linkages intersect. The planes, for example, may be normal to each other.

A control system (not shown) controls the operation of the trash compactor. The control system can take inputs such as whether the inlet door is open, how many times the inlet door has been opened, the time since the last operation of the compacting mechanism, the current draw of the motor and so forth to operate the trash compactor. One possible mode of operation involves operating the compacting mechanism after the inlet door has been opened a predetermined number of times. For example, after the inlet door has been opened seven times, the control system locks the inlet door shut and operates the compacting mechanism. The stroke length of the platen may be determined by how many times the compacting mechanism has been operated since the liner to the trash receptacle has been last changed, it might be operated until a predetermined amount of force has been applied to the trash by the platen, or it might have a fixed length unless a predetermined force level has been exceeded. Other operating modes may be programmed as desired.

The compacting mechanisms described herein may be suitable for other uses than in a trash compactor. Any application where force is applied evenly over a surface may be suitable. For example, the compacting mechanism may be suitable for use in a machine press or a printing press.

Various embodiments of the invention have now been described in detail. Since changes, alterations and additions to the above described embodiments may be made without departing from the nature, spirit or scope of the invention, the invention is not to be limited to the embodiments described above, but rather the scope of the invention is defined only by the appended claims.

| Numeral Reference List | |
|---|---|
| 10 | Trash Compactor |
| 12 | Housing |
| 14 | Upper Door |
| 16 | Lower Door |
| 18 | Inlet Door |
| 20 | Compacting mechanism |
| 22 | Trash receptacle |
| 24 | Frame |
| 26 | Lower door latch |
| 28 | Upper door latch |
| 30 | Speaker aperture |
| 32 | Signal light aperture |
| 34 | Proximity sensor |
| 36 | Hinge (for inlet door) |
| 38 | Additional inlet door sensors |
| 40 | Inlet door opening mechanism. |
| 42 | T-shaped linkage |
| 44 | Pin |
| 46 | Strut |
| 48 | Motor |
| 50 | Rear posts (of frame) |
| 52 | Front posts (of frame) |
| 54 | Top frame |
| 56 | Bottom frame |
| 58 | Front cross-piece (of frame) |
| 60 | Wheels (of frame) |
| 62 | Trash receptacle support |
| 64 | Channels |
| 66 | Top cross-piece |
| 68 | Screw actuator bracket |
| 70 | Bracket(s) |
| 72 | Drive mechanism |
| 74 | Moving plate |
| 75 | Guide block |
| 76 | Lip |
| 77 | Bevel |
| 78 | Linkages |
| 79 | Wheel |
| 80 | Platen |
| 81 | Side walls (of platen) |
| 82 | Motor |
| 83 | Upper lip (of platen) |
| 84 | Belt |
| 85 | Handle |
| 86 | Drive pulley |

-continued

| Numeral Reference List | |
|---|---|
| 88 | Driven pulley |
| 90 | Floating bearing. |
| 92 | Upper linkage |
| 94 | Lower linkage |
| 96 | Drive linkage |
| 100 | Drive Mechanism |
| 102 | Linkage |
| 200 | Drive mechanism |
| 204 | Linkage |
| 206 | Drive arm |
| 208 | Lower arm |
| 210 | Second linkage |
| 212 | Upper arm |
| 214 | Lower arm |
| 216 | Balance linkages |

What is claimed is:

1. A side loading trash compactor, comprising:

a frame defining a cavity;

a receptacle for containing trash disposed within the frame;

a platen movable to compress trash collected in the receptacle;

a first set of linkages having a first end attached to the frame by a first simple hinge joint, the first simple hinge joint having an axis of rotation, and a second end attached to the platen by a second simple hinge joint, the first set of linkages operating in a first plane normal to the axis of rotation of the first simple hinge joint;

a second set of linkages having a first end attached to the frame by a third simple hinge joint, the first simple hinge joint having an axis of rotation, and a second end attached to the platen by a fourth simple hinge joint, the second set of linkages operating in a second plane normal to the axis of rotation of the third simple hinge joint; and a drive mechanism configured to move a plate up and down, wherein the first and second planes intersect and wherein the drive mechanism includes a vertically oriented screw actuator.

2. A side loading trash compactor, comprising:

a frame defining a cavity;

a receptacle for containing trash disposed within the frame;

a platen movable to compress trash collected in the receptacle;

a first set of linkages having a first end attached to the frame by a first simple hinge joint, the first simple hinge joint having an axis of rotation, and a second end attached to the platen by a second simple hinge joint, the first set of linkages operating in a first plane normal to the axis of rotation of the first simple hinge joint;

a second set of linkages having a first end attached to the frame by a third simple hinge joint, the first simple hinge joint having an axis of rotation, and a second end attached to the platen by a fourth simple hinge joint, the second set of linkages operating in a second plane normal to the axis of rotation of the third simple hinge joint; and a drive mechanism configured to move a plate up and down, wherein the first and second planes intersect and wherein the drive mechanism includes the plate.

3. The trash compactor of claim 2 wherein the first set of linkages includes a drive linkage connected to the plate by a simple hinge joint and wherein the second set of linkages includes a linkage connected to the plate by a simple hinge joint.

4. The trash compactor of claim 3, further including a third set of linkages having a first end attached to the frame by a simple hinge joint and a second end attached to the platen by a simple hinge joint, the third set of linkages operating essentially parallel to the first set of linkages.

5. The trash compactor of claim 4, further including a fourth set of linkages having a first end attached to the frame by a simple hinge joint and a second end attached to the platen by a simple hinge joint, the fourth set of linkages operating essentially parallel to the second set of linkages.

6. The trash compactor of claim 3 wherein the first set of linkages includes a first linkage connected by a simple hinge joint to a second linkage.

7. The trash compactor of claim 6 wherein the first linkage is connected to the frame by the first simple hinge joint and wherein the second linkage is connected to the platen by the second simple hinge joint.

8. A side loading trash compactor, comprising:

a frame defining a cavity;

a receptacle for containing trash disposed within the frame;

a platen movable to compress trash collected in the receptacle;

a first set of linkages having a first end attached to the frame by a first simple hinge joint, the first simple hinge joint having an axis of rotation, and a second end attached to the platen by a second simple hinge joint, the first set of linkages operating in a first plane normal to the axis of rotation of the first simple hinge joint;

a second set of linkages having a first end attached to the frame by a third simple hinge joint, the first simple hinge joint having an axis of rotation, and a second end attached to the platen by a fourth simple hinge joint, the second set of linkages operating in a second plane normal to the axis of rotation of the third simple hinge joint; and a drive mechanism configured to move a plate up and down, wherein the first and second planes intersect;

a housing surrounding the frame on the sides and the top of the trash compactor, wherein the housing includes an inlet door for the ingress of trash, the inlet door being set into an upper access door; and an inlet door opening mechanism, the inlet door opening mechanism that has a first portion attached to the frame and a second portion attached to the upper access door, wherein the first and second portions of the inlet door mechanism are separated when the upper access door is opened and wherein the second portion includes a downward facing surface that, when an upward force is applied to the surface, opens the inlet door and wherein the downward facing surface is on a linkage that has a single, vertical degree of freedom and wherein the linkage is connected by a hinge to an inlet door linkage, and wherein the inlet door linkage is connected by a hinge to the inlet door.

9. A side loading trash compactor, comprising:

a frame defining a cavity;

a trash receptacle for collecting trash disposed in the cavity;

a platen for compacting trash in the trash receptacle; and a platen driving mechanism having a first and second set of sets of linkages, each set of linkages having a first end connected by a simple hinge joint to the platen, wherein each simple hinge joint has an axis of rotation and wherein each set of linkages moves in a plane normal to the axis of rotation of its simple hinge joint and wherein the planes of the first and second sets of linkages are perpendicular to each other, and wherein the platen comprises:

a bottom plate having a perimeter;

a side wall extending around the perimeter and disposed above the bottom plate, the side wall having a top; and a lip extending horizontally out from the top of the side wall wherein the trash receptacle has a top having an outer perimeter, and wherein the lip has an outer perimeter that is larger than the outer perimeter of the top of the trash receptacle.

10. A side loading trash compactor, comprising:

a frame defining a cavity;

a trash receptacle for collecting trash disposed in the cavity;

a platen for compacting trash in the trash receptacle; and a platen driving mechanism having a first and second set of sets of linkages, each set of linkages having a first end connected by a simple hinge joint to the platen, wherein each simple hinge joint has an axis of rotation and wherein each set of linkages moves in a plane normal to the axis of rotation of its simple hinge joint and wherein the planes of the first and second sets of linkages are perpendicular to each other, wherein the platen driving mechanism includes a vertically oriented screw actuator.

11. The trash compactor of claim 10 wherein the platen driving mechanism includes a movable plate mechanically disposed between the screw actuator and the first and second set of linkages.

12. A side loading trash compactor, comprising:

a frame defining a cavity;

a trash receptacle for collecting trash disposed in the cavity;

a platen for compacting trash in the trash receptacle; and a platen driving mechanism having a first and second set of sets of linkages, each set of linkages having a first end connected by a simple hinge joint to the platen, wherein each simple hinge joint has an axis of rotation and wherein each set of linkages moves in a plane normal to the axis of rotation of its simple hinge joint and wherein the planes of the first and second sets of linkages are perpendicular to each other, wherein the first set of linkages includes an upper linkage, a lower linkage and a drive linkage, wherein the upper linkage is connected to the frame by a simple hinge joint and to the lower linkage by a simple hinge joint, wherein the lower linkage is connected to the platen at the first end, and wherein the drive linkage is connected to the platen driving mechanism by a simple hinge joint and to the upper linkage by a simple hinge joint, wherein the platen comprises a bottom plate having a perimeter, a side wall extending around the perimeter and disposed above the bottom plate, the side wall defining a cavity, wherein the platen has a raised position, and wherein the upper linkage and the lower linkage are disposed within the cavity of the platen when the platen is in the raised position.

* * * * *